US005857923A

United States Patent [19]

Veller

[11] Patent Number: 5,857,923

[45] Date of Patent: Jan. 12, 1999

[54] SEPARABLE GOLF CLUB SHAFT

[75] Inventor: Daniel H. Veller, Elmhurst, Ill.

[73] Assignee: Pack-A-Putter Corporation, Elmhurst, Ill.

[21] Appl. No.: 408,478

[22] Filed: Mar. 22, 1995

[51] Int. Cl.[6] ..... A63B 53/12

[52] U.S. Cl. ..... 473/316

[58] Field of Search ..... 273/80 R, 80.1, 273/80.2, 80.3, 80.4, 80.5, 80.7, 80.8, 80.9, 80 D; 403/354, 360, 370; 81/177.1; 16/110 R; 473/316, 322, 323, 298, 305

[56] References Cited

U.S. PATENT DOCUMENTS

| | | | |
|---|---|---|---|
| 2,859,992 | 11/1958 | Levy | 273/80.7 |
| 3,170,691 | 2/1965 | Pritchard | 273/80.8 |
| 3,269,730 | 8/1966 | Miller et al. | 273/80.9 |
| 3,334,901 | 8/1967 | Steffes | 273/80.8 |
| 4,253,666 | 3/1981 | Murphy | 273/80.1 |
| 4,340,227 | 7/1982 | Dopkowski | 273/80.1 |
| 4,664,382 | 5/1987 | Palmer et al. | 273/80.1 |
| 5,039,098 | 8/1991 | Pelz | 273/80.8 |

FOREIGN PATENT DOCUMENTS

| | | | |
|---|---|---|---|
| 4326 | 11/1911 | United Kingdom | 273/80.8 |

*Primary Examiner*—Steven Wong
*Attorney, Agent, or Firm*—Douglas B. White

[57] ABSTRACT

The separable shaft of the present invention employs plugs adhesively secured within adjoining shaft ends, with one plug exhibiting a male thread and the other exhibiting a female thread. The adjoining shaft ends are sized to fit one tightly within the other and the plugs are positioned to cause one shaft end to overlap and to frictionally engage the other shaft end.

6 Claims, 1 Drawing Sheet

SEPARABLE GOLF CLUB SHAFT

BACKGROUND OF THE INVENTION

1. Field of the Invention

This invention relates generally to golf shafts, particularly of the type having stepped cylindrical sections. More specifically, this invention relates to a separable shaft for a golf club which facilitates portability without sacrificing performance or feel.

2. Description of the Prior Art

Portable versions of golf clubs have been presented in the prior art. In one version the shaft collapses in many sections telescopically, and in another version solid wooden shaft sections screw together in abutting relation. While these prior art shafts have successfully achieved portability, they have failed to maintain the same feel and performance of the one piece shafts. Recently, the popularity of shafts having stepped cylindrical sections (U.S. Pat. No. 4,558,863) have further compounded the portability problem due to its complicated design.

SUMMARY OF THE INVENTION

The separable shaft of the present invention employs plugs for insertion into adjoining shaft ends, with one plug exhibiting a male thread portion and the other exhibiting a female thread portion. The shaft ends are sized to cause one shaft end to overlap and frictionally engage the other adjoining shaft end.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
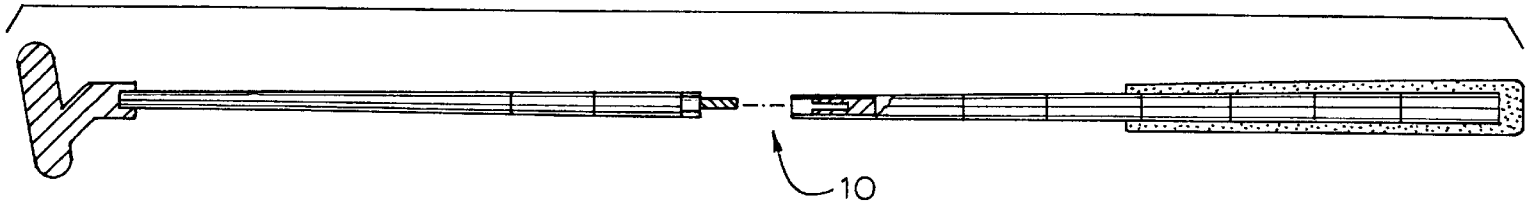
FIG. 1 is a pictorial view of a golf club with a separable shaft in accordance with the present invention.

Turning to FIG. 1 there is shown a golf club having a stepped cylindrical shaft which is separated in accordance with the present invention. Near the middle of the shaft a joint 10 serves to connect the sections of the shaft and to facilitate portability.

Figure 2:
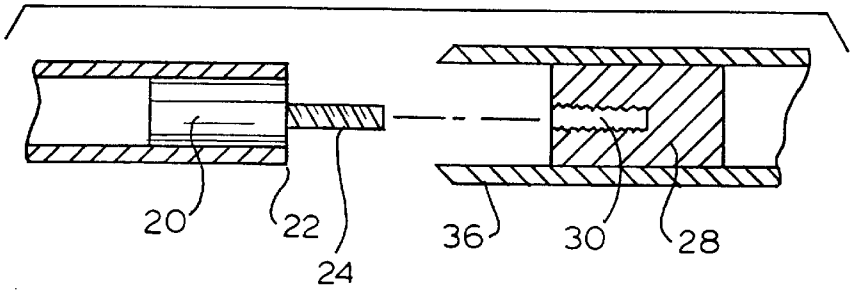
FIG. 2 is a cut away view of the joint of the shaft of FIG. 1, separated.
Figure 3:
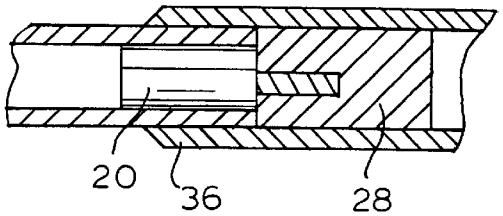
FIG. 3 is a cut away view of the connected joint of the shaft of the present invention.

The joint 10 is shown in detail in FIGS. 2 and 3 and comprises a first plug 20 positioned within the smaller shaft end, flush with its extremity 22. This plug is secured therein with an adhesive, such as epoxy, and presents a threaded male portion 24. A second plug 28 is recessed into the adjoining larger shaft end and exhibits a threaded female portion 30 for receipt of the male portion. (The threaded portions of the first and second plugs may be interchanged without deviating from the scope of this invention.) When the plugs are joined together (FIG. 3) an overlapping of the shaft ends occurs: the inner surface of the larger shaft end overlaps the outer surface of the smaller shaft end.

The joint further includes means for engaging the overlapping inner surface of the larger shaft end with the overlapped outer surface of the smaller shaft end. To accomplish this, in the preferred embodiment a protruding portion 36 of the larger shaft end is sized to achieve a tight frictional engagement with the outer surface of the adjoining smaller shaft section end when the threaded plug portions are fully engaged (FIG. 3). When so joined the overlapped sections of the shaft sufficiently communicate the stress forces occurring within the shaft and thereby preserve the feel of the one piece shaft.

When converting a typical stepped cylindrical shaft (shown in FIG. 1) to a portable version, the shaft is severed at both ends of an intermediate step portion, which step portion is then removed from the middle of the shaft. The larger diameter shaft section can then be slightly reamed, if necessary, to accept the smaller diameter shaft section. In one method of manufacture, the plug with the male thread is inserted into the smaller diameter shaft section and secured with epoxy adhesive. The plug with the female thread portion is similarly inserted into the larger diameter shaft section, recessed by about ¼", and secured therein with epoxy. When the shaft sections are then joined together, they overlap by the aforesaid ¼" and force the walls of the cylindrical shaft sections into frictional engagement.

From the foregoing description, it will be apparent that modifications can be made to the apparatus and method for using same without departing from the teachings of the present invention. Accordingly, the scope of the invention is only to be limited as necessitated by the accompanying claims.

I claim:

1. In a golf club shaft of the hollow cylindrical type the improvement comprising:

a plurality of separate shaft sections presenting shaft section ends having an inner surface and an outer surface, wherein adjoining shaft section ends comprise a smaller end and a larger end for overlapping said smaller end;

means for connecting adjoining ends of said shaft sections; and means for engaging the overlapping inner surface of said larger end with the overlapped outer surface of said smaller end.

2. The golf club shaft of claim 1 wherein said means for engaging the overlapping inner surface of said larger end with the overlapped outer surface of said smaller end comprises frictional engagement.

3. The golf club shaft of claim 1 wherein said means for connecting adjoining shaft section ends comprising a first plug affixed within a first of said adjoining shaft section ends and exhibiting a protruding male thread portion, and a second plug affixed within a second of said adjoining shaft section ends and exhibiting a female thread portion therein, wherein mating of said threaded portions results in an overlap of said shaft sections and engagement of said shaft section ends at said overlap.

4. The golf club shaft of claim 3 wherein one of said plugs is recessed within a respective one of said shaft ends.

5. The golf club shaft of claim 4 wherein said plugs are secured within said respective shaft sections by adhesive means.

6. The golf club shaft of claim 5 wherein said means for engaging the overlapping inner surface of said larger end with the overlapped outer surface of said smaller end comprises frictional engagement.

* * * * *